US006403938B2

(12) United States Patent
Witonsky et al.

(10) Patent No.: US 6,403,938 B2
(45) Date of Patent: Jun. 11, 2002

(54) MICROWAVABLE SYSTEM AND METHOD OF FACILITATING MICROWAVE HEATING OF LIQUIDS

(75) Inventors: Robert J. Witonsky, Princeton; John W. Scarantino, Mercerville, both of NJ (US); John C. Estill, Carlsbad; Ronald M. Benincasa, Olivenhan, both of CA (US); Robert A. Barish, Mercerville, NJ (US)

(73) Assignee: Medical Indicators, Inc., Carlsbad, CA (US)

( * ) Notice: Subject to any disclaimer, the term of this patent is extended or adjusted under 35 U.S.C. 154(b) by 0 days.

(21) Appl. No.: 09/888,839

(22) Filed: Jun. 25, 2001

Related U.S. Application Data

(63) Continuation-in-part of application No. 08/738,165, filed on Oct. 25, 1996, now Pat. No. 6,222,168.

(51) Int. Cl.[7] ..... H05B 6/80

(52) U.S. Cl. ..... 219/689; 219/687; 219/729; 219/732; 426/241; 99/DIG. 14

(58) Field of Search ..... 219/687, 689, 219/688, 728, 729, 745, 736, 732, 734; 99/DIG. 14; 426/234, 241, 243

(56) References Cited

U.S. PATENT DOCUMENTS

| | | | | | |
|---|---|---|---|---|---|
| 4,703,149 | A | * | 10/1987 | Sugisawa et al. | 219/729 |
| 5,079,396 | A | * | 1/1992 | Katz et al. | 219/689 |
| 5,315,084 | A | * | 5/1994 | Jensen | 219/689 |
| 5,498,857 | A | * | 3/1996 | Jacquault | 219/745 |
| 6,222,168 | B1 | * | 4/2001 | Witonsky et al. | 219/687 |

* cited by examiner

*Primary Examiner*—Philip H. Leung
(74) *Attorney, Agent, or Firm*—Foley & Lardner; Bernard L. Kleinke

(57) ABSTRACT

A system and method for facilitating microwave heating of a liquid includes the use of a generally cylindrical holder for receiving the liquid to be heated. A shielding sleeve at least partially composed of high microwave reflectivity material, blocks microwave energy from entering a selected interior portion only of the holder to prevent direct microwave heating of the liquid in the selected portion. As a result, there are shielded and unshielded portions of the liquid being heated to cause the liquid to be heated to a substantially uniform temperature throughout the liquid being heated. A mechanism enables the sleeve to be positioned such that the blocking portion of the sleeve is positioned at or above the level of the liquid disposed within the interior of the holder so that the top layer of the liquid is shielded from direct microwave heating to prevent unwanted super heating of a portion of the liquid and thus causing hot spots.

12 Claims, 1 Drawing Sheet

MICROWAVABLE SYSTEM AND METHOD OF FACILITATING MICROWAVE HEATING OF LIQUIDS

CROSS-REFERENCE TO RELATED APPLICATIONS

The present patent application is a continuation-in-part application of U.S. patent application Ser. No. 08/738,165, filed Oct. 25, 1996 now U.S. Pat. No. 6,222,168, which is incorporated herein by reference.

STATEMENT REGARDING FEDERALLY SPONSORED RESEARCH OR DEVELOPMENT

The U.S. Government has a paid-up license in this invention and the right in limited circumstances to require the patent over to license others on reasonable terms as provided for by the terms of Grant No. 2 R44 CE00063-02 awarded by the Centers for Disease Control and Center for Injury Prevention and Control.

BACKGROUND OF INVENTION

1. Technical Field

The present invention relates in general to a system and method for facilitating the microwave heating of a liquid. The invention more particularly relates to a method and system which can be readily used in a convenient manner for heating liquids to a uniform temperature, while being contained in a variety of different sizes and shapes of containers.

2. Background Art

In the co-pending foregoing-mentioned parent patent application, there is disclosed a system and method for heating liquids, such as milk or baby formula in a specially equipped baby bottle by utilizing microwave energy in a safe and convenient manner. Utilization of the apparatus and method disclosed in the foregoing patent facilitates the heating of milk or baby formula to a uniform temperature, thus avoiding oral or pharyngeal injury to the consumer of the hot liquid. Such an injury can otherwise result from microwave heating of the milk or formula in ordinary baby bottles by utilizing conventional microwave ovens.

While such a system and method has proven to be highly successful, it would be desirable to have a new and improved system and method which facilitates the microwave heating of the milk, formula or other liquids contained in a variety of different sizes and shapes of conventional containers in a safe manner to a uniform temperature. For example, some milk or baby formula can be dispensed in a conventional plastic sack container supported within a rigid frame. Thus, it would be desirable to be able to microwave heat liquid in such a container or a variety of different containers in a safe manner utilizing the principles of the foregoing parent patent application. Moreover, it would be desirable to be able to heat other types of substances, such as blood plasma stored in a plastic non-uniform shaped container, such as a plastic package, to a uniform temperature in a convenient manner.

Furthermore, it would be highly useful to microwave heat other types of food products, such as soup or other comestibles with or without the use of its original container for the liquid. In this regard, for example, soup products and other such comestibles are frequently packaged in metal containers which ordinarily can not be heated in a conventional microwave oven.

Thus, it would be highly desirable to be able to heat liquids to a uniform temperature in a conventional microwave oven, independent of the type or kind of original package for the liquid.

BRIEF DESCRIPTION OF THE DRAWINGS

The above-mentioned and other objects and features of this invention and the manner of attaining them will become apparent, and the invention itself will be best understood by reference to the following description of the embodiment of the invention in conjunction with the accompanying drawings, wherein.

Briefly, a system is provided which receives either the liquid directly into the apparatus, or alternatively receives the original package, which contains the liquid to be heated. The original package containing the liquid to be heated can be a variety of different sizes, shapes and materials. As a result, the liquid can be readily heated to a uniform temperature in a conventional microwave oven, without the requirement of stirring or agitation during heating.

A system and method for facilitating microwave heating of a liquid may include the use of a generally cylindrical holder for receiving the liquid to be heated. A shielding sleeve at least partially composed of high microwave reflectivity material, blocks microwave energy from entering a selected interior portion only of the holder to prevent direct microwave heating of the liquid in the selected portion. As a result, there are shielded and unshielded portions of the liquid being heated to cause the liquid to be heated to a substantially uniform temperature throughout the liquid being heated. A mechanism enables the sleeve to be positioned such that the blocking portion of the sleeve is positioned at or above the level of the liquid disposed within the interior of the holder so that the top layer of the liquid is shielded from direct microwave heating to prevent unwanted super heating of a portion of the liquid and thus causing hot spots.

The holder may receive the liquid to be heated, with or without its original package. For example, a baby bottle containing milk or formula may be placed in the holder for heating. Alternatively, a comestible, such as a soup, may be removed from its original metal or other package and then poured directly into the holder for heating. Also, different non-uniform shaped, non-rigid containers may also be readily positioned within the holder for heating purposes.

BEST MODE FOR CARRYING OUT THE INVENTION

Figure 1:
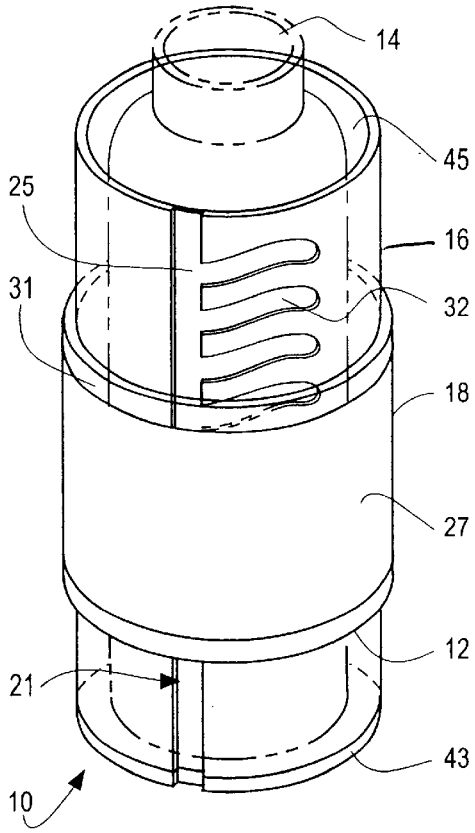
FIG. 1 is a pictorial view of a microwavable system, which is constructed in accordance with the present invention.

Referring now to the drawings, and more particularly to FIG. 1 thereof, there is shown a microwavable system 10 which generally comprises a holder or support generally indicated at 12 for receiving a container such as a baby bottle 14. As shown and described herein, the bottle 14 is a conventional plastic baby bottle composed of microwavable energy transparent material. In this manner, the contents of the bottle in the form of milk or baby formula can be readily heated in a conventional microwave oven (not shown) in a safe manner to a uniform temperature to avoid unwanted hot spots, especially at the top level of the liquid. However, as will become apparent from those skilled in the art, instead of a conventional baby bottle, a variety of different types and kinds of non-rigid and even non-cylindrical containers may be heated within the system 10. Also, the liquid, for example, such as soup to be heated by microwave energy can be poured directly into the system 10 and heated therein.

The support 12 generally comprises a cylindrical holder 16 and a microwave shielding tubular sleeve 18 telescopically and axially slidably surrounding the outer surface the holder 16. The holder 16 and the sleeve 18 are each preferably composed of suitable rigid transparent or translucent thermoplastic material. The holder is at least partially composed of microwave energy transparent material to permit the microwave energy to penetrate the holder and the bottle 14 to heat the contents thereof in the microwave oven.

A positioning adjusting mechanism generally indicated at 21 generally comprises a detent 23 received within a groove or channel generally indicated at 25 for facilitating axial adjustment of the sleeve relative to the holder to enable the sleeve to be positioned such that the upper blocking portion of the sleeve is positioned above the level of the liquid disposed within the interior of the bottle 14. In this regard, the top layer of the liquid is shielded from direct microwave heating to prevent unwanted heating of a top layer of the liquid to cause the desired uniform heating of the liquid contained within the bottle 14 as more fully described in the foregoing mentioned pending patent application.

In order to render the sleeve 18 reflective of microwave energy, a microwave reflective band 27 is attached to the outer surface of the sleeve 18 and entirely surrounds it to reflect microwave energy from entering the interior of the holder 16 and its contents. It will become apparent to those skilled in the art that the entire sleeve may be composed of microwave reflective material itself.

Figure 2:
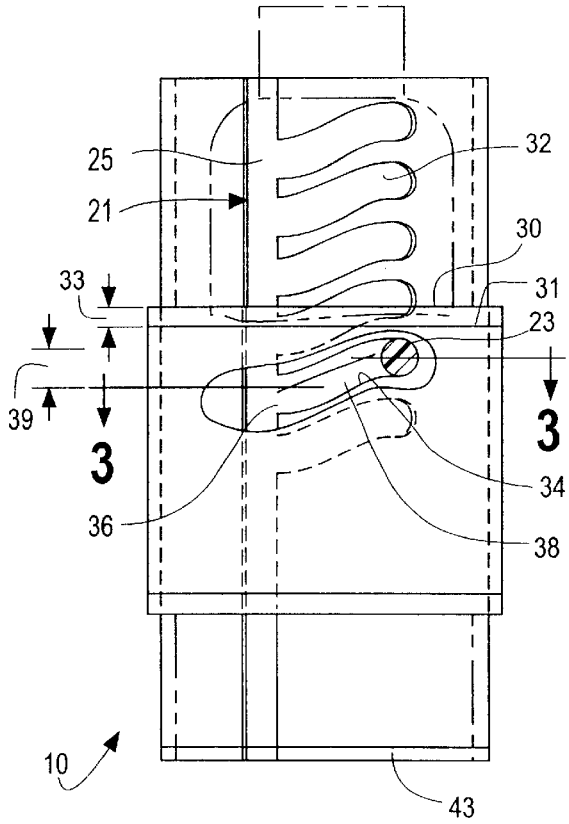
FIG. 2 is an enlarged elevational view of the system of FIG. 1 with a portion thereof shown broken away for illustration purposes.
Figure 3:
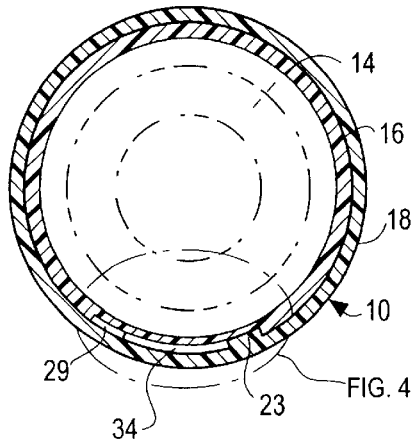
FIG. 3 is a sectional view of the system of FIG. 2 taken substantially on line 3—3 thereof.
Figure 4:
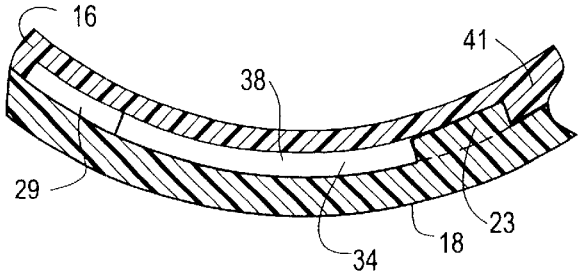
FIG. 4 is an enlarged detailed view of FIG. 3 taken substantially as shown within curved line 4 of FIG. 3.

Considering now the groove 25 in greater detail with reference to FIGS. 2–4 of the drawings, the groove 25 generally comprises a rectilinear axially extending portion 29 extending the length of the sleeve on the outer surface thereof for receiving the detent 23. In this regard, the sleeve 18 can be slid axially by the hand of the user to an adjusted position for aligning a top edge 30 of the sleeve 18 relative to the liquid level (not shown) within the bottle 14. A top edge 31 of the band 27 is spaced by a substantial axial distance 33 from the sleeve top edge 30 to insure that the shielding of the microwave heating is properly blocked to enable the liquid to be heated in accordance with the uniform heating principles disclosed in the foregoing mentioned patent application.

A set of equally-spaced apart branch portions, such as branch portions 32 and 34 are integrally connected to the axial rectilinear linear portion 29 to enable the sleeve 18 to be moved positionally into adjusted positions by ratcheting the sleeve 18 along the branch portion of the groove 25. The branch, such as the branch 34 (FIG. 2) comprises an entrance 36 at the axial portion 29 and an upperly extending gently curved intermediate portion 38 terminating in an upper distal end 41.

In use, the sleeve 18 is grasped by the hand of the user and slid axially relative to the holder 16. As a result, the detent 23 slides along the axial portion 29 of the groove 25 until the top edge of the sleeve 18 is disposed opposite to the level of the liquid in the bottle 14 as viewed through the transparent holder 16 and sleeve 18. Thereafter, the sleeve 18 is rotated relative to the holder 16 and the detent 23 enters the entrance 36 of the branch 34 and is cammed upwardly along the intermediate portion 38 until it engages the distal end 41 of the branch portion 32. In this manner, the top edge 30 of the sleeve 18 is moved upwardly along the holder to a position where the top edge 31 of the shielding branch 27 is positioned above the liquid level in the bottle 14 to ensure that the upper portion of the liquid is completely concealed from the microwave energy to prevent inadvertent hot spots or heating of the upper level of liquid. For this purpose, an axial distance 39 between the entrance 36 and the distal end 41 for each branch is greater than the axial spacing between the sleeve top edge 30 and the band top edge 31. Each branch is substantially the same size and shape as each other branch, and is spaced axially from its next adjacent upper branch such that the distal end of the lower branch terminates at about the lower portion of the next upper branch.

Once the bottle 14 containing the liquid to be heated is inserted within the interior of the holder 16 and the shielding sleeve 18 is positionally adjusted, the system 10 is then placed within a conventional microwave oven (not shown) to heat the contents of the bottle 14. In this regard, the sleeve 18 is positioned above the bottom end of the holder 16 to permit microwave energy to penetrate the holder 16 and the bottle 14 for heating the liquid contained within the bottle 14. In this manner, as more fully described in the subject parent patent application, the liquid is heated to a substantially uniform temperature throughout the liquid to avoid unwanted injury to the consumer and to provide a convenient manner of uniform heating of a liquid.

Considering now the holder 16 in greater detail, with reference to FIGS. 1 and 2 of the drawings, the holder 16 may include a bottom wall 43 for supporting the bottle 14 from below, and an open top 45 (FIG. 1) for permitting access to the hollow interior of the holder 16. It will become apparent to those skilled in the art that the holder may be modified by having a removable bottom wall or even omitting the bottom wall for certain applications. Also, it will become apparent to those skilled in the art that a comestible, such as soup or the like contained in original packages composed of metal or other non-microwavable material, can be removed from their original container and positioned within the hollow interior of the holder 16 for heating purposes in a microwave oven.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A system for facilitating microwave heating of a liquid, comprising:

a cylindrical holder for receiving at its interior the liquid to be heated by microwave energy, said holder being at least partially composed of microwave energy transparent material;

shielding means being at least partially composed of high microwave reflectivity material and being disposed on a surface of said holder for blocking microwave energy from entering a selected interior portion only thereof to prevent direct microwave heating of the liquid in said selected portion so that there are shielded and unshielded portions of the liquid being heated to cause substantial uniformity of temperature throughout the liquid being heated; and means for facilitating axial adjustment of said shielding means relative to said holder to enable said shielding means to be positioned such that the upper blocking portion thereof is positioned at or above the level of the liquid disposed within the interior of said holder whereby the top layer of the liquid is shielded from direct microwave heating to prevent unwanted heating of a top layer of liquid.

2. A system according to claim 1, wherein said shielding means includes a sleeve.

3. A system according to claim 2, wherein said sleeve includes a band having said high microwave reflectivity material.

4. A system according to claim 3, wherein said means for facilitating axial adjustment includes a position adjusting mechanism having a detent on one of said band and said sleeve, and a groove on the other one of said band and said sleeve for receiving said detent.

5. A system according to claim 4, wherein said groove includes an axially extending portion and a plurality of axially spaced apart branches.

6. A system according to claim 5, wherein each one of the branches has substantially the same size and shape.

7. A system according to claim 5, wherein each one of said branches include an entrance at said axially extending portion, an upwardly extending portion and a distal end portion.

8. A system according to claim 7, wherein said band is spaced axially by a distance from the top edge of the sleeve.

9. A system according to claim 8, wherein the axial distance between the entrance and the distal end of each one of said branches is greater than the axial distance between said band and the top edge of said sleeve to insure the desired positioning of the shielding material relative to the level of the liquid to be heated.

10. A system according to claim 7, wherein the axial distance between the entrance of each brand and its distal end is greater than the axial spacing between the sleeve top edge and the band top edge.

11. A system according to claim 10, wherein each branch is spaced axially from its next adjacent upper branch so that the distal end of the lower branch terminates at about the lower portion of the next upper branch.

12. A method of facilitating microwavable heating of a liquid to a uniform temperature using the system according to claim 1, positioning the liquid within the interior of said holder; and adjusting said shielding means positionally to an axial position relative to the level of the liquid to be heated.

* * * * *